US011965330B2

(12) United States Patent
Bond

(10) Patent No.: US 11,965,330 B2
(45) Date of Patent: Apr. 23, 2024

(54) BUILDING SYSTEM

(71) Applicant: Arthur H. Bond, Plantation, FL (US)

(72) Inventor: Arthur H. Bond, Plantation, FL (US)

( * ) Notice: Subject to any disclaimer, the term of this patent is extended or adjusted under 35 U.S.C. 154(b) by 0 days.

(21) Appl. No.: 17/511,012

(22) Filed: Oct. 26, 2021

(65) Prior Publication Data

US 2022/0154459 A1 May 19, 2022

Related U.S. Application Data

(60) Provisional application No. 63/115,166, filed on Nov. 18, 2020.

(51) Int. Cl.
*E04B 2/84* (2006.01)
*E04B 2/00* (2006.01)
*E04B 2/86* (2006.01)

(52) U.S. Cl.
CPC ..... *E04B 2/845* (2013.01); *E04B 2/8658* (2013.01); *E04B 2002/8688* (2013.01)

(58) Field of Classification Search
CPC . E04B 2/845; E04B 2/8658; E04B 2002/8688
USPC ..... 52/348
See application file for complete search history.

(56) References Cited

U.S. PATENT DOCUMENTS 461,960 A * 10/1891 McCarthy ..... E04B 1/161 52/426
1,462,934 A * 7/1923 Fluor ..... E04B 2/845 264/31
1,524,404 A * 1/1925 Oliver ..... E04B 2/845 52/410
1,530,662 A * 3/1925 Hensel ..... E04B 2/845 52/378
1,982,104 A * 11/1934 Holdsworth ..... E04B 2/845 52/353
2,189,872 A * 2/1940 Ulrich ..... E04B 2/84 264/317
2,250,798 A * 7/1941 Gibson ..... E04B 2/845 52/349

(Continued)

FOREIGN PATENT DOCUMENTS

FR 1594209 A * 6/1970 ..... E04B 2/845
FR 2244886 A1 * 4/1975 ..... E04B 2/845

(Continued)

*Primary Examiner* — Brian D Mattei
*Assistant Examiner* — Joseph J. Sadlon
(74) *Attorney, Agent, or Firm* — The Rapacke Law Group, P.A.; Andrew S. Rapacke

(57) ABSTRACT

A building system and method of using the same may include a wall assembly including a plurality of expanded metal mesh sheets disposed on either side of at least one welded wire mesh sheet. The wall assembly may be disposed in a keyway defined by a foundation assembly including a plurality of form boards. The foundation assembly may be constructed and arranged for framing out a slab, wall, or structure. The building system may further include a framing assembly including a plurality of vertical supports spaced away from one another and being constructed and arranged to connect to a support header and plurality of spans such that a structure or wall may be formed within the framing assembly. Material, such as concrete, maybe poured between the plurality of expanded metal mesh sheets to form a slab, wall, or structure.

13 Claims, 9 Drawing Sheets

(56) References Cited

U.S. PATENT DOCUMENTS 2,262,899 A * 11/1941 Mechlin ..... E04B 2/84 52/380
2,298,989 A * 10/1942 Underwood ..... E04B 2/58 52/351
2,368,620 A * 2/1945 Strom ..... E04B 2/845 52/489.1
2,457,982 A * 1/1949 Deichmann ..... E04C 2/386 52/270
2,627,176 A * 2/1953 Levy ..... E04B 2/42 52/704
2,653,469 A * 9/1953 Callan ..... E04B 2/84 52/712
2,964,821 A * 12/1960 Meehan ..... E04B 2/847 52/410
3,188,773 A * 6/1965 Harris ..... E04B 2/723 52/444
3,555,751 A * 1/1971 Thorgusen ..... E02D 19/04 249/40
3,845,601 A * 11/1974 Kostecky ..... E04B 1/2403 52/656.1
3,858,376 A * 1/1975 Moore ..... E04B 1/163 52/DIG. 9
3,950,902 A * 4/1976 Stout ..... E04B 5/48 52/607
3,968,615 A * 7/1976 Ivany ..... E04B 2/8629 52/592.1
4,098,042 A * 7/1978 Sachs ..... E04B 2/68 52/576
4,104,842 A * 8/1978 Rockstead ..... E04B 2/8617 52/649.1
4,125,981 A * 11/1978 MacLeod ..... E04B 1/161 52/351
4,186,160 A * 1/1980 Landreth ..... E04B 1/0007 249/34
4,253,288 A * 3/1981 Chun ..... E04B 2/845 264/46.7
4,261,150 A * 4/1981 Sartorio ..... B28B 15/00 52/565
4,320,606 A * 3/1982 GangaRao ..... E04C 2/521 52/600
4,338,759 A * 7/1982 Swerdlow ..... E04B 1/165 52/742.14
4,349,492 A * 9/1982 Shoham ..... E04G 11/18 264/333
4,461,130 A * 7/1984 Shubow ..... E04B 1/20 52/236.8
4,494,353 A * 1/1985 Lewis ..... E04B 2/845 52/354
4,697,398 A * 10/1987 Granieri ..... E04H 9/02 52/236.8
4,750,306 A * 6/1988 Granieri ..... E02D 27/50 52/251
4,765,115 A * 8/1988 Pollina ..... E04B 2/20 52/712
4,805,364 A * 2/1989 Smolik ..... E04B 2/7457 52/745.12
4,914,879 A * 4/1990 Goldberg ..... E04C 2/34 52/282.1
4,943,336 A * 7/1990 Csont ..... E04B 2/8658 156/182
4,972,646 A * 11/1990 Miller ..... E04B 2/8647 52/426
4,987,719 A * 1/1991 Goodson, Jr. ..... E04B 1/24 52/378
4,998,393 A * 3/1991 Baena ..... E04B 1/161 52/258
5,353,560 A * 10/1994 Heydon ..... E04B 7/22 52/592.1
5,375,809 A * 12/1994 Goto ..... E04G 17/047 249/16
5,398,472 A * 3/1995 Eichelkraut ..... E04B 1/165 52/380
5,579,620 A * 12/1996 Kuo ..... E04B 1/0023 52/447
5,724,783 A * 3/1998 Mandish ..... E04B 2/58 52/404.3
5,729,942 A * 3/1998 Moore, Jr. ..... E04C 1/40 52/211
5,771,654 A * 6/1998 Moore ..... E04B 2/54 52/745.1
5,797,233 A * 8/1998 Hascall ..... E04C 3/07 52/489.1
5,799,453 A * 9/1998 Westerlund ..... E04B 1/161 52/250
5,878,544 A * 3/1999 McKinnon ..... E04B 2/8629 52/439
6,058,672 A * 5/2000 McClellan ..... E04B 1/04 52/592.1
6,082,059 A * 7/2000 Loomans ..... B28B 7/30 52/143
6,112,489 A * 9/2000 Zweig ..... E04B 2/847 52/745.1
6,122,888 A * 9/2000 Bodnar ..... E04C 3/09 52/262
6,370,835 B1 * 4/2002 Morgan ..... E04B 1/24 52/92.1
6,494,004 B1 * 12/2002 Zimmerman ..... B28B 19/003 249/35
6,568,141 B2 * 5/2003 Kremers ..... E02D 27/02 249/34
6,622,452 B2 * 9/2003 Alvaro ..... E02D 27/02 52/294
6,663,322 B1 * 12/2003 Listle ..... E02B 3/06 52/297
6,820,387 B2 * 11/2004 Sacks ..... E04F 13/04 52/363
6,907,698 B1 * 6/2005 Bond ..... E04B 2/845 52/354
6,920,729 B2 * 7/2005 Konopka ..... E04C 5/163 52/262
7,073,306 B1 * 7/2006 Hagaman ..... E04B 1/3555 249/34
7,254,925 B2 * 8/2007 Stefanutti ..... E02D 27/02 52/576
7,278,244 B1 * 10/2007 Rubio ..... E04C 3/07 52/351
7,444,793 B2 * 11/2008 Raftery ..... E04B 1/3404 52/79.14
7,637,073 B2 * 12/2009 Elliott ..... F41H 5/04 52/DIG. 9
7,694,483 B1 * 4/2010 Tucker ..... E04B 1/28 52/92.2
7,836,660 B2 * 11/2010 Gharibeh ..... E04B 5/026 52/364
8,429,876 B2 * 4/2013 Aburto ..... E04B 1/161 52/378
8,733,048 B1 * 5/2014 Hanson ..... E04B 1/16 52/348
8,793,950 B2 * 8/2014 Hill ..... E04B 1/26 52/283
8,844,223 B2 * 9/2014 Zhong ..... E04B 2/10 52/259
9,091,055 B2 * 7/2015 Jensen ..... E04B 2/40
9,175,470 B2 * 11/2015 Yin ..... E04B 2/8635
9,499,984 B2 * 11/2016 Manning ..... E04C 5/012
9,631,366 B2 * 4/2017 Mei ..... E04B 1/26
9,856,639 B2 * 1/2018 Koszo ..... E04B 1/165
9,945,118 B2 * 4/2018 Matys ..... B28B 7/0079
10,024,024 B2 * 7/2018 Boyce ..... E02D 27/013
10,058,791 B2 * 8/2018 Norfleet ..... A63H 33/105
10,253,511 B2 * 4/2019 Sollars ..... B28B 7/241
10,364,569 B2 * 7/2019 Crumley ..... F16B 31/028
10,533,339 B2 * 1/2020 Wilsey ..... E04C 5/07
10,633,875 B2 * 4/2020 Clevenger ..... E04G 19/003
10,661,473 B2 * 5/2020 Renke ..... E04B 2/707
10,689,843 B1 * 6/2020 Raccuia ..... E04C 5/168
11,352,787 B2 * 6/2022 Amend ..... E04B 2/8647

(56) References Cited

U.S. PATENT DOCUMENTS

| | | | | |
|---|---|---|---|---|
| 11,739,521 | B2 * | 8/2023 | Lim | E04B 1/165 52/125.1 |
| 11,834,825 | B2 * | 12/2023 | Blackburn | E04G 11/08 |
| 2004/0200177 | A1 * | 10/2004 | Okumura | C08L 67/02 52/633 |
| 2005/0275124 | A1 * | 12/2005 | Franklin | B32B 13/08 264/333 |
| 2008/0016802 | A1 * | 1/2008 | Rheaume | E04C 2/26 52/220.1 |
| 2009/0255209 | A1 * | 10/2009 | Boesch | E04G 15/02 52/742.14 |
| 2012/0031027 | A1 * | 2/2012 | Burks | E04H 9/14 52/745.12 |
| 2013/0074432 | A1 * | 3/2013 | Ciuperca | E04B 1/161 52/309.4 |
| 2015/0059275 | A1 * | 3/2015 | Nanayakkara | E04B 1/165 52/348 |
| 2015/0191922 | A1 * | 7/2015 | Giat | E04B 1/161 249/219.1 |
| 2019/0169844 | A1 * | 6/2019 | Yousefi Darestani | E04B 1/165 |
| 2019/0360201 | A1 * | 11/2019 | Matys | B28B 1/14 |
| 2020/0123768 | A1 * | 4/2020 | Niepceron | E04B 2/8647 |
| 2022/0024820 | A1 * | 1/2022 | Prante | B32B 13/04 |

FOREIGN PATENT DOCUMENTS

| | | | | |
|---|---|---|---|---|
| FR | 2359255 | A1 * | 2/1978 | E04B 2/842 |
| GB | 350467 | A * | 5/1931 | E04B 1/08 |
| WO | WO-9839530 | A1 * | 9/1998 | E04B 1/165 |
| WO | WO-2015094395 | A1 * | 6/2015 | E04B 1/16 |

* cited by examiner

BUILDING SYSTEM

CROSS-REFERENCE TO RELATED APPLICATIONS

This application claims the benefit of U.S. Provisional Application No. 63/115,166 filed Nov. 18, 2020 and which is incorporated herein by reference.

TECHNICAL FIELD

The present disclosure relates to a building system and method for constructing a structure having a plurality of vertical sidewalls.

BACKGROUND

Systems and methods utilized for forming structures fail to provide flexible means for constructing walls or structures in a module manner having adequate vertical and horizontal support throughout the entire construction process in addition to having the capacity to install materials such as pouring concrete in an efficient manner. Systems and methods utilized for forming structures also fail to provide modular building systems that are easy to assemble prior to forming a structure and easy to disassemble after the structure has formed.

BRIEF DESCRIPTION OF THE DRAWINGS

A complete understanding of the present embodiments and the advantages and features thereof will be more readily understood by reference to the following detailed description, appended claims, and accompanying drawings, wherein:

Figure 1:
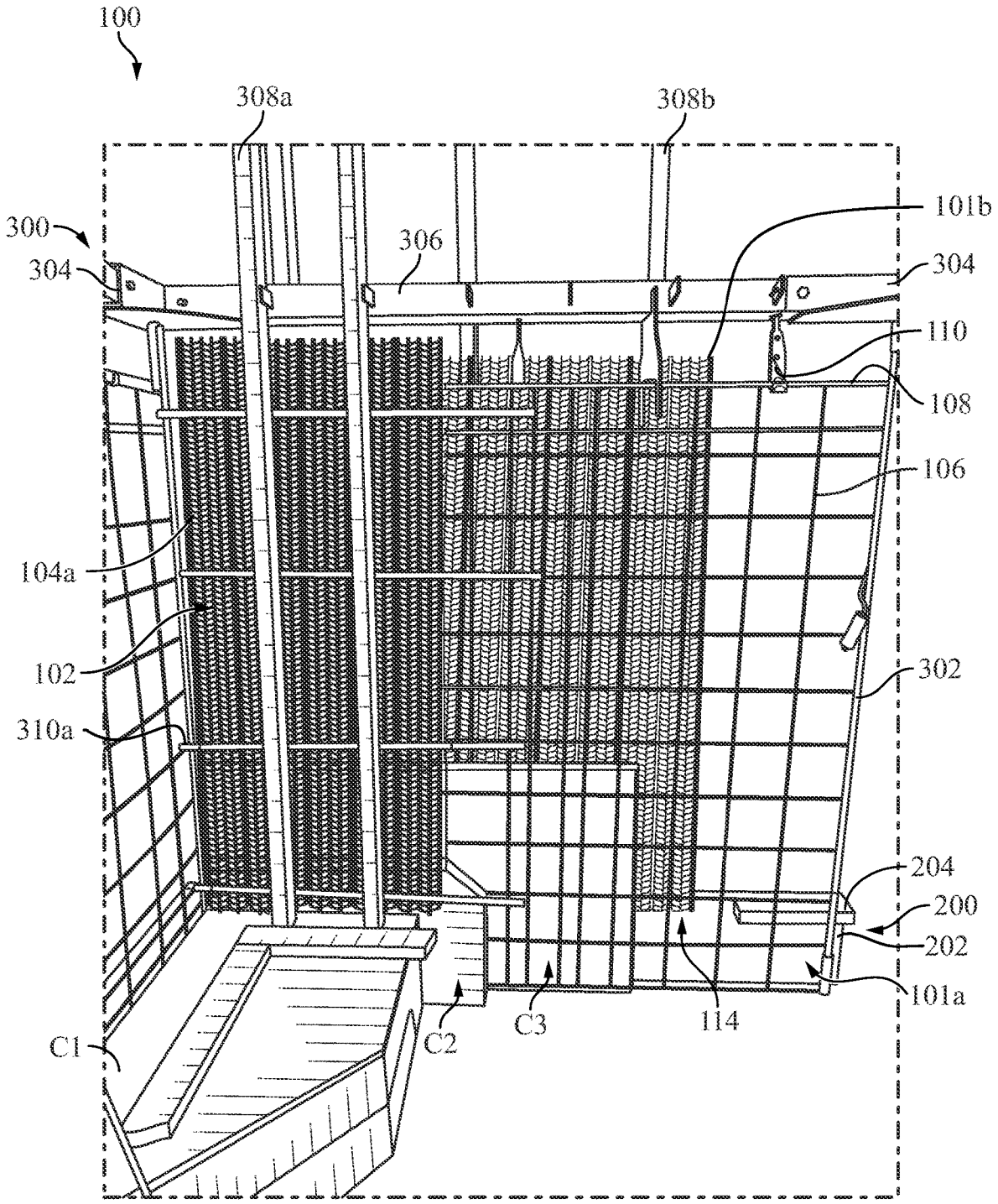
FIG. 1 illustrates an interior view of a building system and method of using the same, according to some embodiments described herein.
Figure 2:
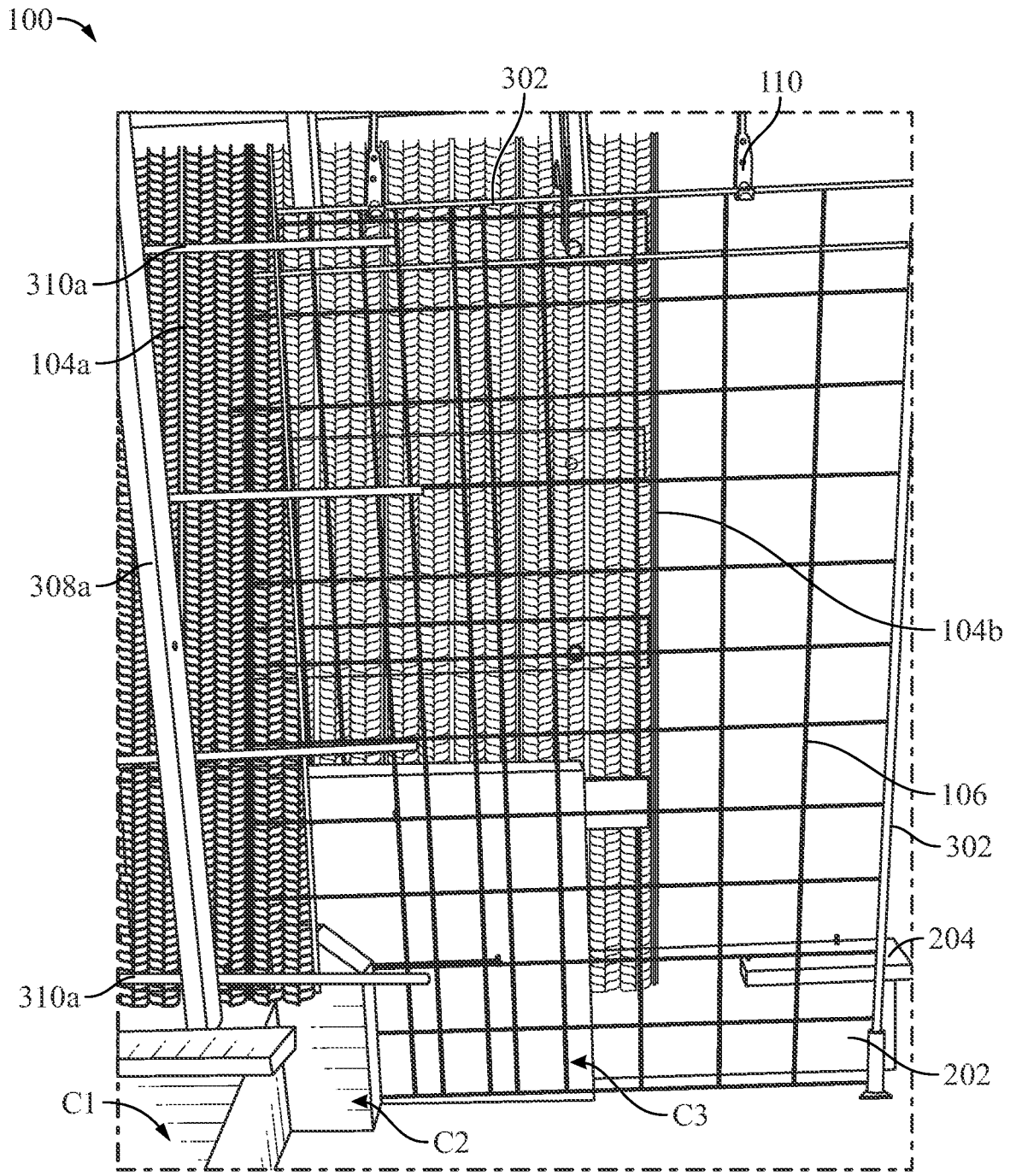
FIG. 2 shows an interior view of a building system and method of using the same of FIG. 1.
Figure 3:
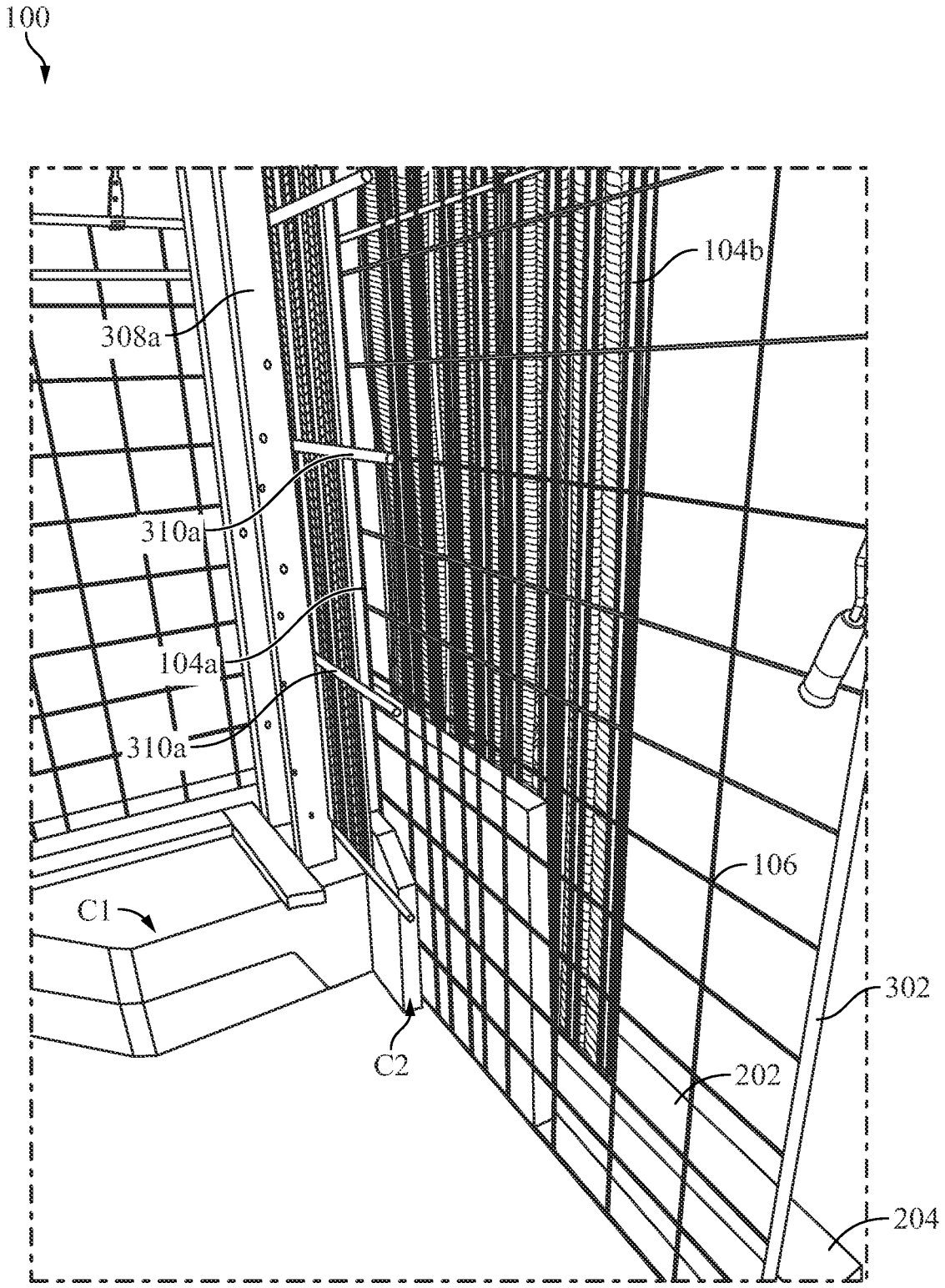
FIG. 3 shows an oblique, interior view of a building system and method of using the same of FIG. 1.

The drawings are not necessarily to scale, and certain features and certain views of the drawings may be shown exaggerated in scale or in schematic in the interest of clarity and conciseness.

DETAILED DESCRIPTION

Reference will now be made in detail to the exemplary embodiment(s), examples of which is/are illustrated in the accompanying drawings. Whenever possible, the same reference numerals will be used throughout the drawings to refer to the same or like parts.

Before describing the exemplary embodiments, it is noted the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the various embodiments described herein are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

In general, a building system as disclosed herein may include a wall assembly including a plurality of expanded metal mesh sheets disposed on either side of at least one welded wire mesh sheet. The wall assembly may be disposed in a keyway defined by a foundation assembly including a plurality of form boards. The foundation assembly may be constructed and arranged for framing out a slab. the building system may further include a framing assembly including a plurality of vertical supports spaced away from one another and being constructed and arranged to connect to a support header and plurality of spans such that a structure or wall may be formed within the framing assembly.

In practice and use, a method for using the building system may include installing a plurality of form boards and attaching a keyboard to the form boards. The method may further include assembling vertical supports outside of the to-be-constructed wall or structure and installing at least one span between adjacent vertical supports and support headers. A plurality of straps including j-hooks may be disposed within each of the spans and may be constructed and arranged to receive horizontal braces within the j-hook. According to some embodiments, at least one welded wire mesh may also be suspended from the straps. The method may further include affixing horizontal braces to vertical braces prior to forming at least one slab or pouring a wall material such as concrete between a first metal mesh sheet and a second metal mesh sheet to form a wall or structure.

As shown in FIGS. 1-10, a building system 100 is provided. In various embodiments, the building system 100 comprises a foundation assembly 200, a framing assembly 300, and a wall assembly 102. In some embodiments, the building system 100 comprises an external side 101*b*, which corresponds to the exterior side of the wall after construction is completed, and an internal side 101*a*, which corresponds to the interior side of the wall after construction is completed.

Figure 4:
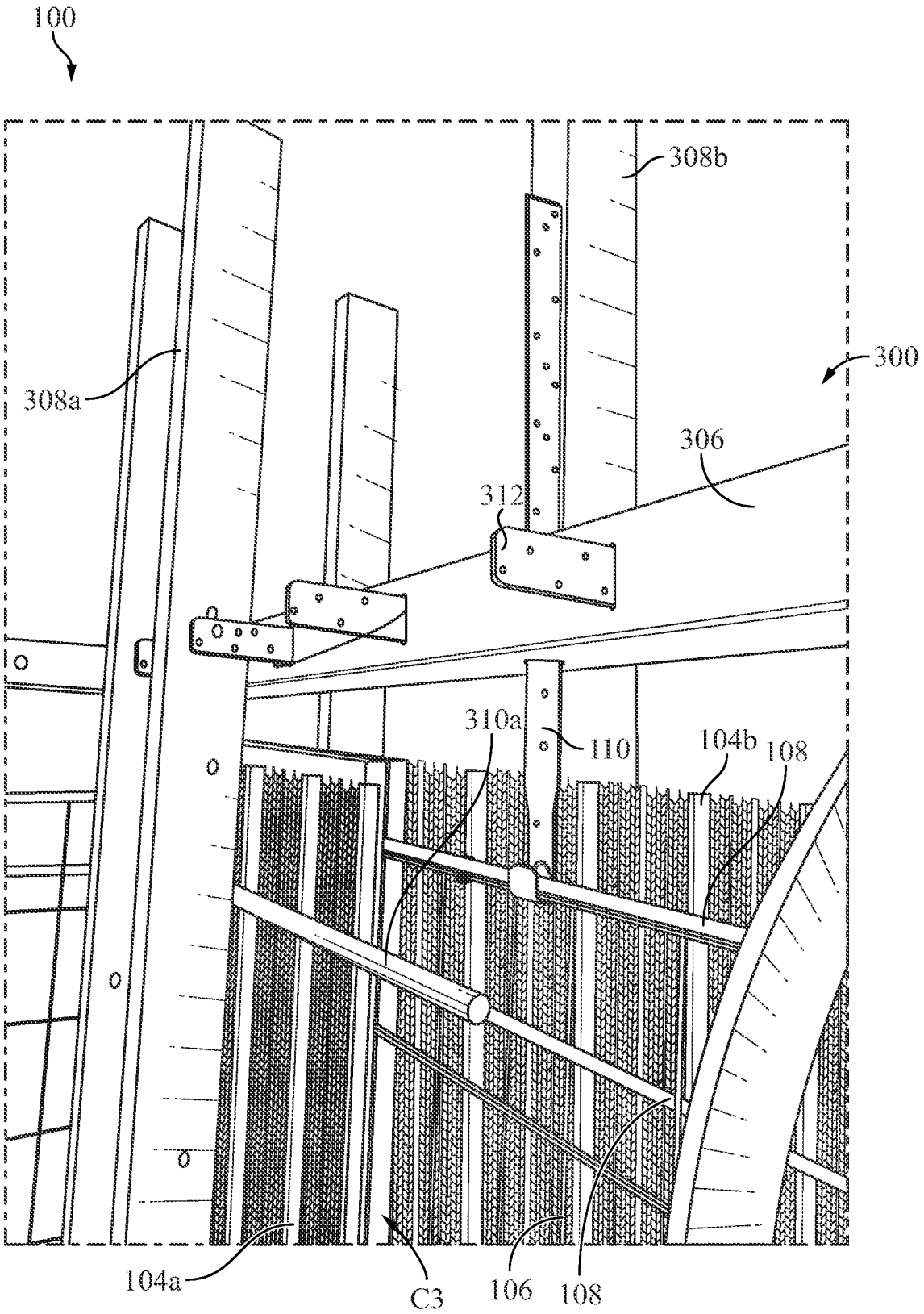
FIG. 4 shows an oblique, interior view of a building system and method of using the same of FIG. 1.
Figure 5:
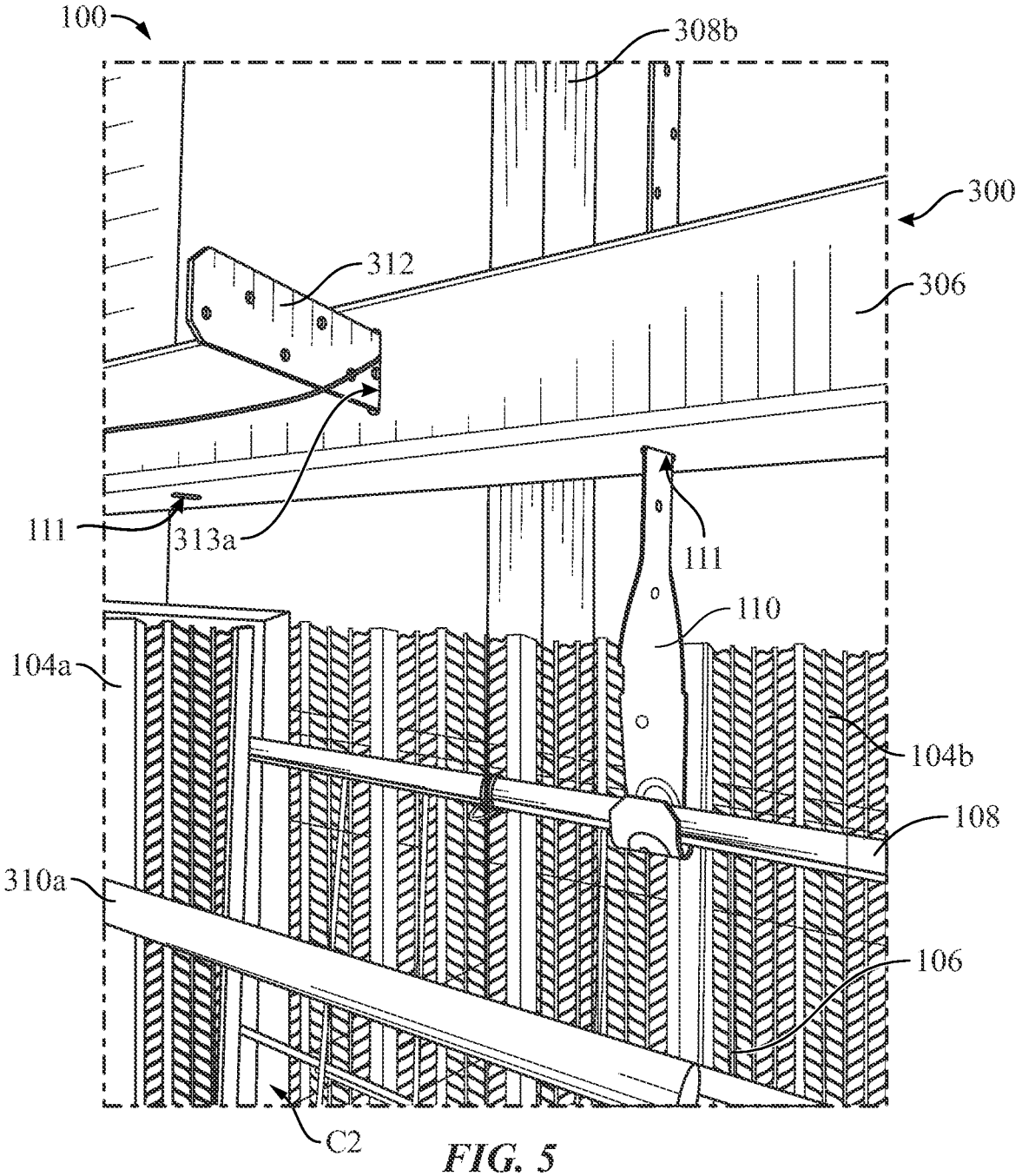
FIG. 5 shows an enlarged view of a building system and method of using the same of FIG. 1.
Figure 6:
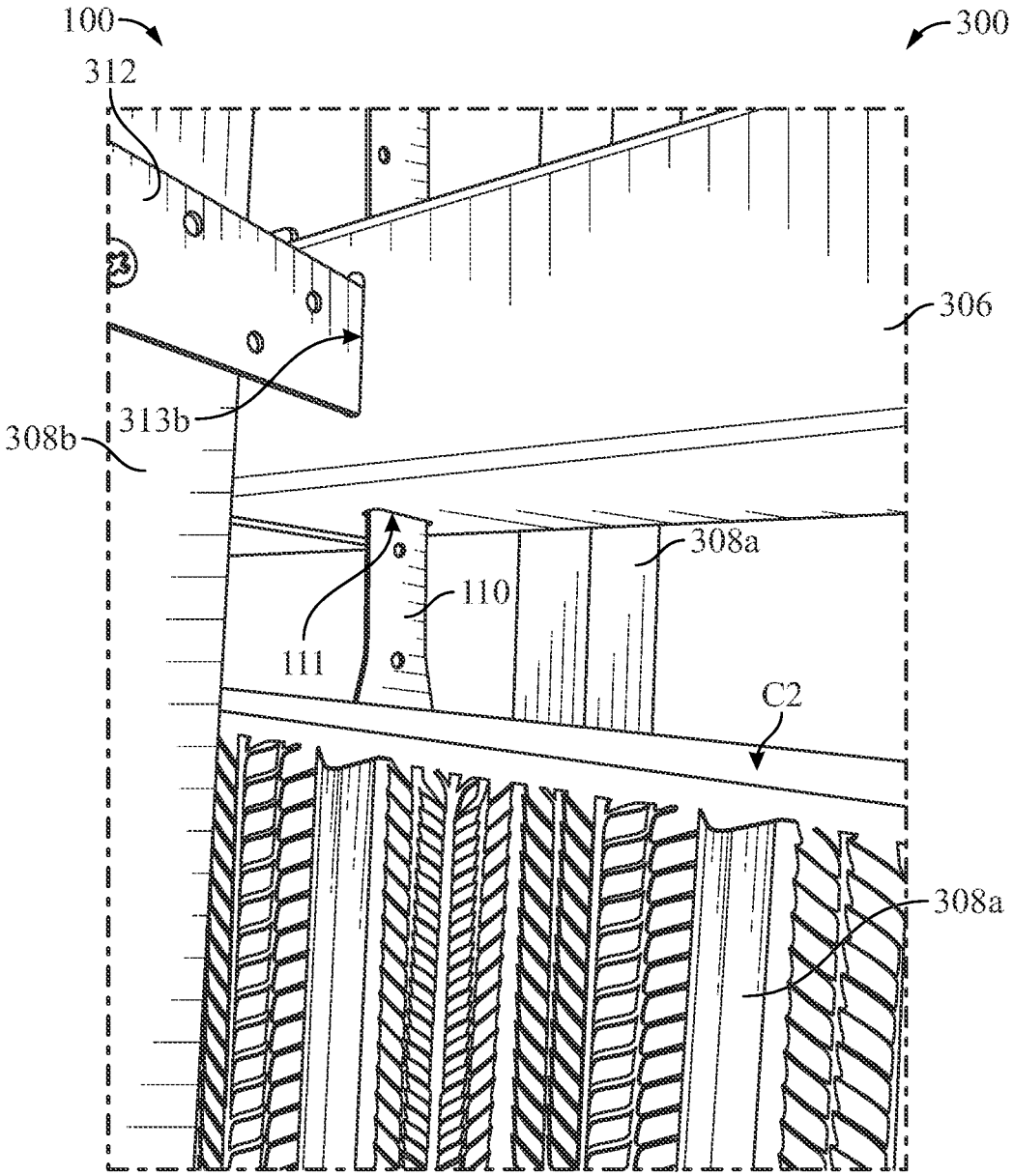
FIG. 6 shows an enlarged view of a building system and method of using the same of FIG. 1.
Figure 7:
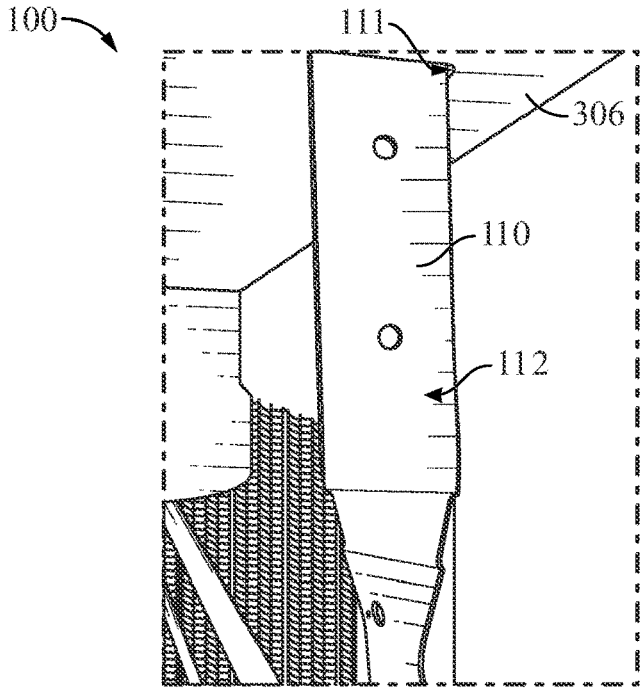
FIG. 7 shows an enlarged view of a building system and method of using the same of FIG. 1.
Figure 8:
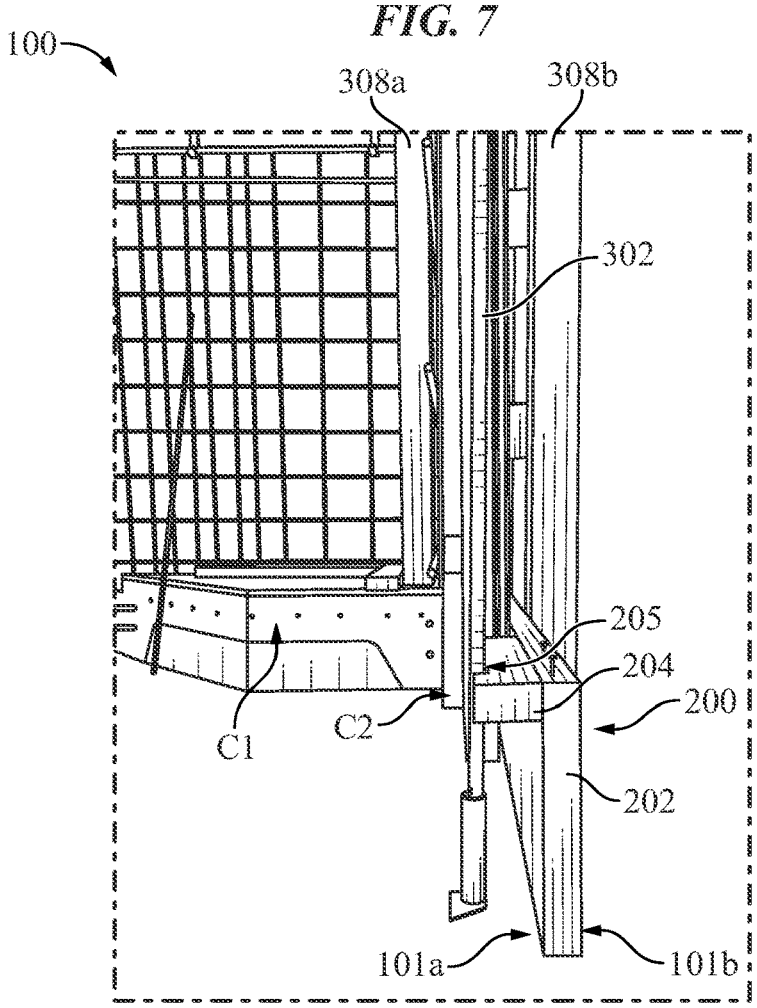
FIG. 8 shows a partial side view of a building system and method of using the same of FIG. 1.
Figure 9:
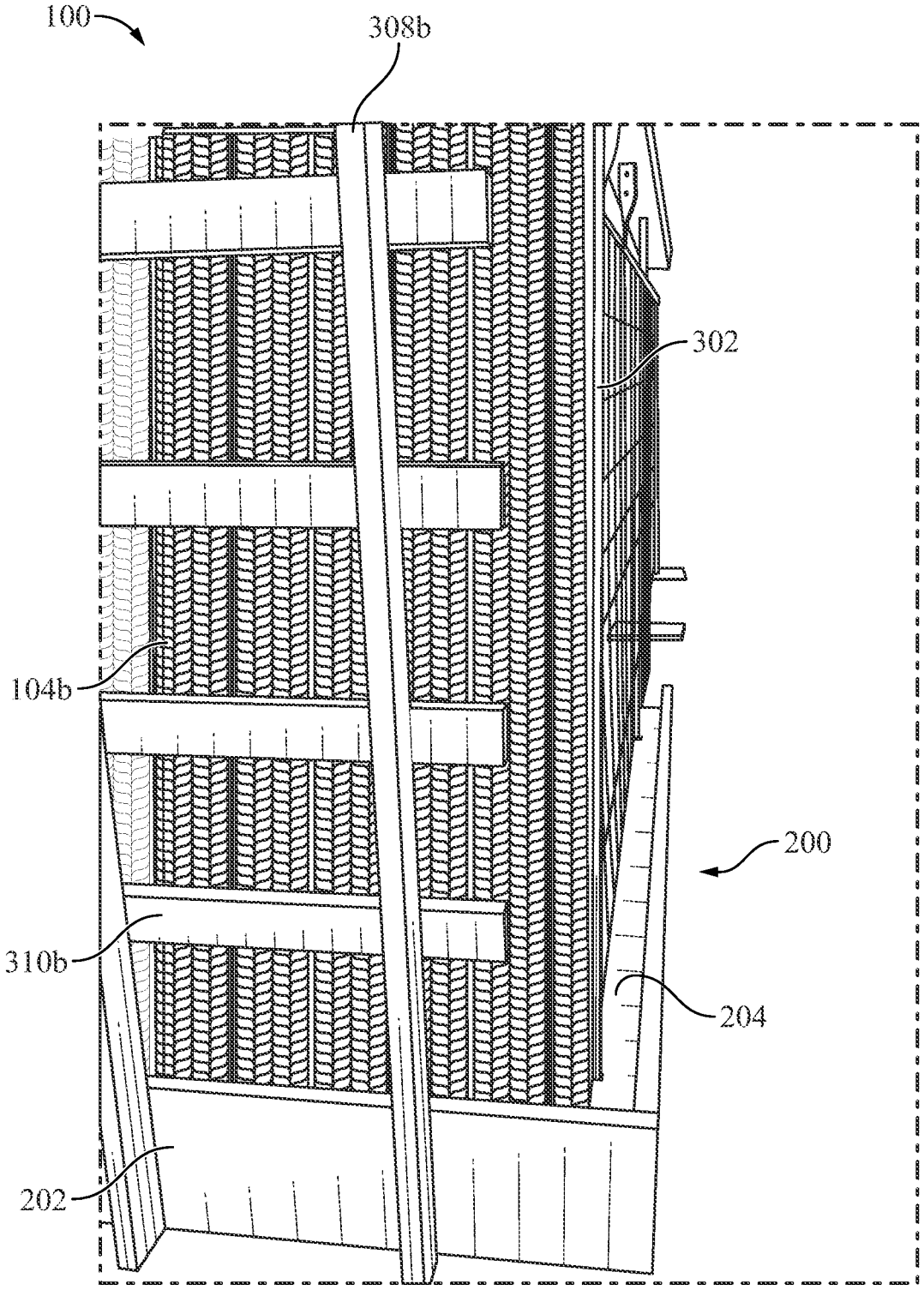
FIG. 9 shows an exterior view of a building system and method of using the same of FIG. 1.
Figure 10:
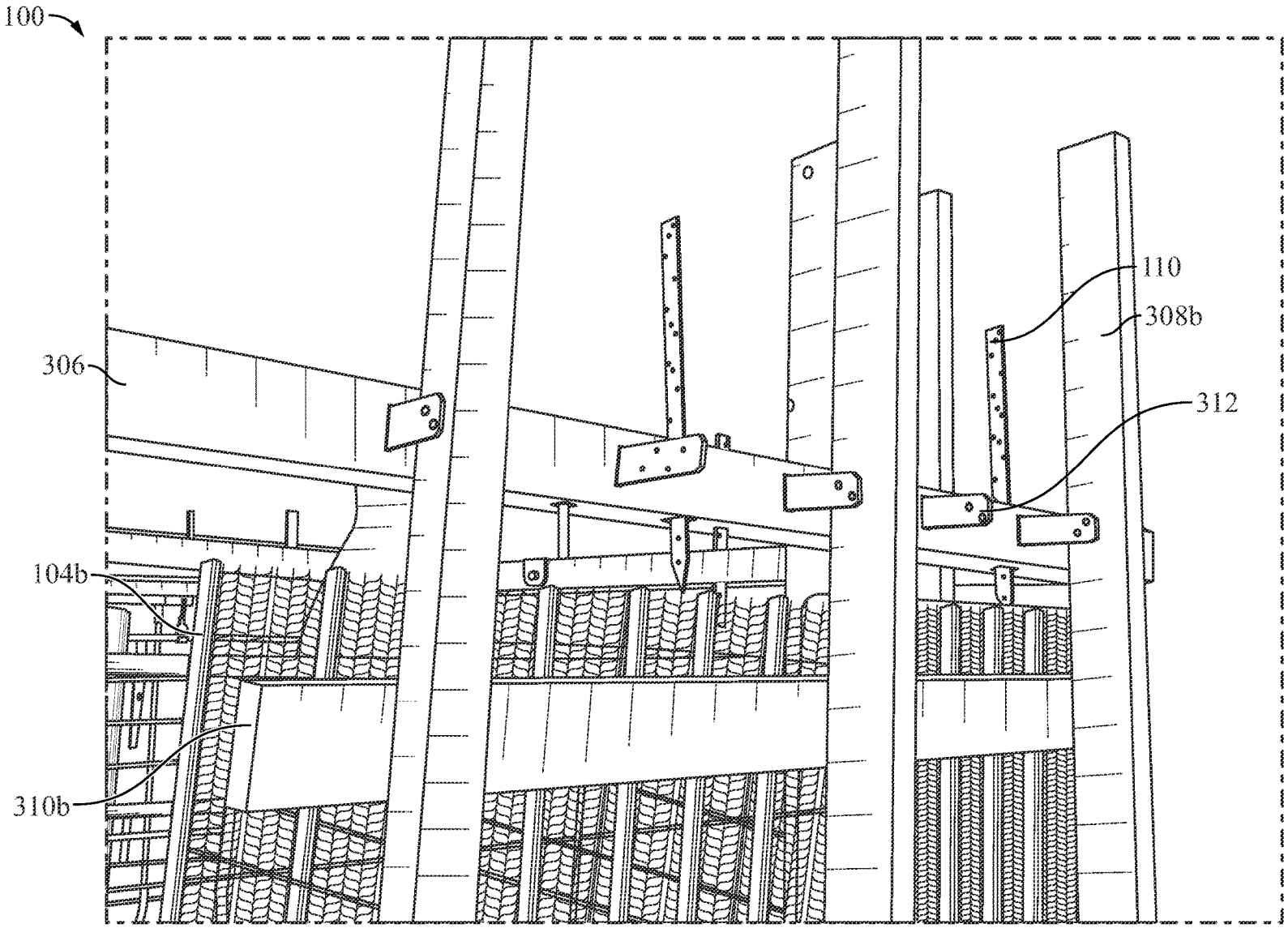
FIG. 10 shows an enlarged, exterior view of a building system and method of using the same of FIG. 1.

In some embodiments, the wall assembly 102 comprises at least one expanded metal mesh sheets 104 and at least one welded wire mesh sheets 106. In some embodiments, the wall assembly 102 comprises a plurality (e.g., two, three, etc.) of expanded metal mesh sheets 104*a*, 104*b*, and a welded wire mesh sheet 106 sandwiched between the two expanded metal mesh sheets 104*a*, 104*b*. In some embodiments, the welded wire mesh sheet 106 and each of the expanded metal mesh sheets 104*a*, 104*b* are positioned a spaced distance from one another as best seen in FIGS. 4 and 5. In such embodiments, the thickness of the to-be-constructed wall will be determined by the spacing between the interior expanded metal mesh sheets 104*a* and the exterior expanded metal mesh sheets 104*b* (the spaced distance including the welded wire mesh sheet 106 therebetween).

In some embodiments, the wall assembly 102 comprises at least one horizonal supports 108. In such embodiments, the supports 108 are positioned laterally between adjacent vertical supports 302. The supports 108 can be any suitable material, including, for example, steel rebar. The supports 108 are sized and shaped to lay on a j-hook portion of at least one vertical strap 110 projecting downward from a span 306, as best seen in FIG. 5. In such embodiments, the j-hook portion of the strap 110 faces toward the interior side of the to-be-constructed wall in order to receive the support 108. In some embodiments, the span 306 comprises a slot 111 that is sized and shaped to receive the vertical strap 110. In some embodiments, the span 306 comprises a plurality of slots 111 on the downward facing surface and a plurality of corresponding slots 111 on the upward facing surface. In such embodiments, the strap 110 passes through the span 306 and projects from the top and bottom faces thereof. In some embodiments, the strap 110 comprises an embedment line 112, which identifies the lower portion of the strap should be submerged within the wall material (e.g., concrete).

In some embodiments, the foundation assembly 200 comprises a plurality of form boards 202 for framing out a slab C1. The form boards 202 can be any suitable material, including, e.g., wood, metal, polymer or a composite material. In some embodiments, the form boards 202 are positioned horizontally with the width of the board having one face in the direction of the interior side of the to-be-constructed wall and the opposite face of the board in the direction of the exterior side of the to-be-constructed wall. The slab C1 can be any suitable material for a building foundation, including, for example, stone, wood, concrete, etc.

The form boards 202 can be any suitable size, including, for example, 1"×12"; 1"×10"; 1.5"×12"; 1.5"×10"; 2"×12"; or 2"×10"; or 4"×12" or 4"×10"; etc. (height×width in inches). All dimensions are interchangeable and/or combinable. The size of the form board 202 is selected based on the desired size of the wall and building structure to be constructed, the local or regional code of building regulations, the terrain where the structure will lay, and/or the preferences of the builder.

In some embodiments, the foundation assembly 200 comprises at least one keyboards 204. In some embodiments, the top surface of the keyboards 204 is flush with the top surface of the form boards 202. In some embodiments, the keyboards 204 are removable; and, when the keyboards 204 are removed, a keyway is provided in the slab C1. In some embodiments, the keyboards 204 are fastened from the external side 101*b* of the form boards 202. The fastener can be any suitable fastener (e.g., screw, nail), and may be removable from the external side 101*b*.

The keyboards 204 can be any suitable size, including, for example, 1"×4"; or 1"×3"; or 1"×2.75"; or 1"×2"; or 1"×1.5"; or 1.5"×4"; or 1.5"×3"; or 1.5"×2.75"; or 1.5"×1.5"; or 2"×4"; 2"×3"; 2"×2.75"; or 2.75"×1.5"; or 2.75"×2" or 2.75"×2.5"; etc. (height×width in inches). All dimensions are interchangeable and/or combinable. The size of the keyboard 204 is selected based on the desired size of the keyway, the local or regional code of building regulations, and/or the preferences of the builder.

In some embodiments, the framing assembly 300, or components thereof, is/are removeable and reusable. In some embodiments, the framing assembly 300 comprises a plurality of vertical supports 302. The supports 302 are structured to be vertically disposed in an underlying surface, in spaced apart relation from one another, and appropriately secured in place. The supports 302 can be any suitable material, including, for example, steel rebar. In this context, a suitable material means the supports 302 are strong enough to hold up an arrangement of support headers 304, spans 306, and associated components without bending. In other words, the supports 302 should maintain a linear or substantially linear shape throughout the process. In some embodiments, the keyboards 204 are adapted to receive the vertical supports 302. For example, a notch 205 can be cut out or otherwise be displaced from the keyboard 204 in the appropriate size and shape to securely receive the support 302. The supports 302 can be any suitable length (i.e., to accommodate a suitable height from the surface of the ground). In some embodiments, the supports 302 are structured to be one inch, or 2", or 3", or 4", etc., from the desired wall height.

In some embodiments, the framing assembly 300 comprises at least one support headers 304. In particular, a support header 304 is structured to be removably disposed on an exposed end of each of the supports 302 that have been previously anchored in the underlying surface (e.g., ground). In some embodiments, each of the support headers 304 includes a mounting hub that removably engages (e.g., a tubular opening that receives) the exposed end of the supports 302, such that after construction of a wall section and/or the entire structure, the support header 304 can be removed from its engaged relation with the supports 302 and reused at a subsequent location. In some embodiments, support headers 304 are structured to receive and removably engage and retain a span 306. In some embodiments, a plurality of spans 306 are provided, each span structured to extend between adjacent supports 302 and their corresponding support headers 304. Additional elements are contemplated for achieving effective and appropriate aligned positioning of the spans 306 between the adjacent supports 302, but also allowing for appropriate removability of the support headers 304 and spans 306 for subsequent reuse.

In some embodiments, the framing assembly 300 comprises at least one vertical braces 308. In such embodiments, the braces 308*a* can be included on the interior side of the to-be-constructed wall and the braces 308*b* can be included on the exterior side of the to-be-constructed wall. The vertical braces 308*a*, 308*b* can be any suitable material, including, for example, wood (e.g., 2'×4') (height×width). In some embodiments, the upper end of a plurality of vertical braces 308 is removably coupled to the span 306. For example, in some embodiments, an upper portion of the vertical braces 308 are coupled to the span 306 using a horizontal strap 312 projecting out from the span 306. In some embodiments, the span 306 comprises at least one slots 313 configured to receive the strap 312. In some embodiments, the span 306 comprises a slot 313*a* on the interior side of the span 306 and a slot 313*b* on the exterior side of the span. In such embodiments, the slots 313*a*, 313*b* are arranged on the opposing faces of the span 306 so the strap 312 can pass entirely through the span 306. In such embodiments, the straps 312 can be coupled to the interior vertical braces 308*a* and the exterior vertical braces 308*b*. In some embodiments, a plurality of interior vertical braces 308*a* are arranged at a lower end on the slab C1. In some embodiments, a plurality of exterior braces 308*b* are arranged at a lower end on the ground.

In some embodiments, the framing assembly 300 comprises at least one horizontal braces 310. In such embodiments, the braces 310*a* can be included on the interior side of the to-be-constructed wall and/or the braces 310*b* can be included on the exterior side of the to-be-constructed wall. The horizontal braces 310*a*, 310*b* can be any suitable material, including, for example, wood (e.g., 2'×4') (height× width), dowl, steel rod, plastic rod, etc. In some embodiments, a plurality of interior horizontal braces 310*a* are removably coupled to at least one components of the wall assembly 102. For example, in FIG. 1, the braces 310*a* are coupled to the interior expanded metal mesh sheets 104*a*. Other configurations are contemplated (e.g., the braces 310*a* can be coupled to the vertical braces 308*a*). In some embodiments, a plurality of exterior horizontal braces 310*b* are removably coupled to the exterior vertical braces 308*b*. Other configurations are contemplated (e.g., the braces 310*b* can be coupled to the exterior expanded metal mesh sheet 104*b*).

In some embodiments, the arrangement and connectivity of the vertical braces 308 and the horizontal braces 310 is configured to maintain the integrity of the desired shape and thickness of the to-be-constructed wall, as dictated in some embodiments by the spacing between the interior expanded metal mesh sheets 104*a* and the exterior expanded metal mesh sheets 104*b* (the spaced distance including the welded wire mesh sheet 106 therebetween).

In various embodiments, a method for constructing a building structure, including a plurality of sidewalls, is provided. In some embodiments, the method comprises installing the form boards 202 about ¾" (0.75") outside of the desired dimensions (e.g., perimeter) of the to-be-constructed walls. Next, a keyboard 204 sized about 2.75"×1.5" (width×height in inches) is attached on the interior side of the form boards 202. In such embodiments, the form board 202 is lying vertical on its side and the keyboard 204 is laid flat so its top surface is flush with the top of the form board 202. The keyboard 204 is sized and shaped to form a keyway in the concrete slab when removed. In some embodiments, the keyboards 204 are attached from the outside surface of the form board 202 with a fastener (e.g., screw, nail) that can be removed later. In some embodiments, the top surface of the form board 202 and the top surface of the keyboard 204 are marked to indicate where the vertical support 302 will be positioned. A notch 205 in the keyboard is then cut out in an appropriate size and shape for accepting the vertical support 302. In some embodiments, supports 302 are installed in all corners and/or locations where a support is needed for the support headers 304. The supports 302 are anchored below the desired footer, and the top of the support 302 is about 2" above the desired wall height. In some embodiments, when installed, the bottom surface of the spans 306 will be about 3" higher than the wall after construction. In some embodiments, the about 3" gap between the bottom surface of the span 306 and the top of the wall above will provide a sufficient gap for pouring in wall material (e.g., pumping concrete in).

In some embodiments, once the vertical supports 302 are stable, the slab steel is placed with the slab mesh extending up the wall approximately 18" to form a starter steel for the wall. In some embodiments, the starter steel is beneficial, but in some instances is optional. In such embodiments, the vertical supports 302, the support headers 304, and spans 306 would be installed before the slab C1 is formed.

Once the supports 302, support headers 304, and spans 306 are installed, the vertical straps 110 are installed with the j-hook facing the interior side of the to-be-constructed wall. Next, the welded wire mesh 106 is suspended from vertical straps 110. In some embodiments, the bottom of the welded wire mesh 106 extends into the footer and supports the footer support bars, and then slab steel is installed. In some embodiments, horizontal braces 108 are installed one in the vertical straps 110. In some embodiments, the slab C1 is then formed, and the keyboards 204 are removed.

In some embodiments, with the keyboards 204 removed, the exterior expanded metal mesh sheets 104*a*, 104*b* is inserted in the keyway 114, and optionally coupled to the form board 202, which is still in place. The top surface of the expanded metal mesh sheets 104*b* should be about 3" below the spans 306 designating the height of the finished wall. In some embodiments, the bottom surface of the interior expanded metal mesh sheets 104*a* rest on the slab C1 and braced by a removable wood board (e.g., 2"×4") attached to the slab C1. The top portion of the interior expanded metal mesh sheets 104*a* is supported by an arrangement of at least one vertical braces 308 and at least one horizontal braces 310. In such embodiments, the at least one vertical braces 308 are coupled to the span 306 using horizontal straps 312.

In some embodiments, cut outs in the structure of the system 100 are made for windows. In some embodiments, the wall material (e.g., concrete) is then pumped in between the spaced distance between the internal expanded metal mesh sheets 104*a* and the external expanded metal mesh sheets 104*b* to obtain the desired wall (e.g., C2 and C3 combined). Once the wall is formed, with the top of the wall meeting the top of the expanded metal mesh sheets 104, the spans 306, support headers 304, supports 302, and form boards 204 can be removed, and the walls are ready to receive roofing trusses, which will be attached to the vertical straps 110.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

Variation 1 may include a building system for forming at least one to-be-constructed structure, including a wall assembly including a plurality of expanded metal mesh sheets and at least one welded wire mesh sheet; a foundation assembly including a plurality of form boards for framing out a slab and at least one keyboards coupled to the form boards; and a framing assembly including a plurality of vertical supports structured to be vertically disposed on an underlying surface, the plurality of vertical supports being in a spaced apart relation from one another, each having an exposed end to removably engage with a support header, and a plurality of spans structured to extend between and be received by adjacent vertical supports.

Variation 2 may include a building system as in variation 1, wherein the wall assembly further includes a plurality of expanded metal mesh sheets and a welded wire mesh sheet disposed between the two expanded metal mesh sheets.

Variation 3 may include a building system as in any of variations 1 through 2, wherein each of the plurality of expanded metal mesh sheets are positioned a distance from one another, the distance between each of the plurality of expanded metal mesh sheets being the thickness of a to-be-constructed wall.

Variation 4 may include a building system as in any of variations 1 through 3, wherein the wall assembly further includes at least one vertical strap including a j-hook.

Variation 5 may include a building system as in any of variations 1 through 4, wherein the at least one vertical strap extends downward from at least one of the plurality of spans and wherein the j-hook is positioned towards an interior side of a to-be-constructed wall in order to receive a support.

Variation 6 may include a building system as in any of variations 1 through 5, wherein at least one of the plurality of spans defines a slot sized and shaped to receive the vertical strap therein.

Variation 7 may include a building system as in any of variations 1 through 6, wherein the span defines a plurality of slots on a downward facing surface of the span and further defines a plurality of corresponding slots on an upward facing surface of the span.

Variation 8 may include a building system as in any of variations 1 through 7, wherein the wall assembly further includes at least one vertical strap including a j-hook an defines an embedment line constructed and arranged to identify a lower portion of the strap to be disposed within a wall material during use.

Variation 9 may include a building system as in any of variations 1 through 8, wherein the wall assembly further includes at least one horizonal support positioned laterally between adjacent vertical supports constructed and arranged to seat within at least one j-hook of at least one strap.

Variation 10 may include a building system as in any of variations 1 through 9, wherein the at least one keyboards are removable and constructed and arranged to define a keyway in a to-be-constructed slab.

Variation 11 may include a building system as in any of variations 1 through 10, wherein the framing assembly includes at least one vertical brace disposed on an interior side and an exterior side of a to-be-constructed wall wherein the at least one vertical brace is removably coupled to the span.

Variation 12 may include a building system as in any of variations 1 through 11, wherein the framing assembly includes at least one exterior horizontal brace removably coupled to the exterior vertical braces.

Variation 13 may include a building system as in any of variations 1 through 12, wherein arrangement and connectivity of the at least one vertical brace and the at least one horizontal brace is configured to maintain the integrity of the desired shape and thickness of a to-be-constructed structure.

According to variation 14, a method for forming at least one to-be-constructed structure may include installing a plurality of form boards approximately outside of desired dimensions of at least one to-be-constructed wall; attaching a keyboard on an interior side of the plurality of form boards such that a top surface of the keyboard is flush with a top of at least one of the plurality of form boards, wherein the keyboard is sized and shaped to define a keyway in the at least one to-be-constructed wall; defining at least one notch in the keyboard to receive at least one vertical support; installing at least one vertical support anchored below a desired footer, the at least one vertical support being constructed and arranged to support at least one support header; installing at least one span constructed and arranged to extend between adjacent vertical supports and support headers; installing at least one vertical strap within the at least one span, the at least one vertical strap including a j-hook where in installing the at least one vertical strap includes positioning the j-hook toward an interior side of a to-be-constructed wall; suspending at least one welded wire mesh from the at least one vertical strap; installing at least one vertical brace; installing at least one horizontal brace within the j-hook; forming at least one slab; removing the at least one keyboard; installing at least one metal mesh sheet; and installing a wall material within the at least one metal mesh sheet to form the at least one to be constructed structure.

Variation 15 may include a method for forming at least one to-be-constructed structure as in variation 14, wherein installing a wall material within the at least one mesh sheet to form the at least one to-be-constructed structure includes pouring concrete.

Variation 16 may include a method for forming at least one to-be-constructed structure as in any of variations 14 through 15 wherein installing at least one metal mesh sheet further includes coupling the at least one metal mesh sheet to at least one form board.

Variation 17 may include a method for forming at least one to-be-constructed structure as in any of variations 14 through 16 wherein the at least one metal mesh sheet is supported by an arrangement of at least one vertical brace and at least one horizontal brace.

Variation 18 may include a method for forming at least one to-be-constructed structure as in any of variations 14 through 17 further including removing the plurality of spans, support headers, plurality of vertical supports, and form boards.

Variation 19 may include a method for forming at least one to-be-constructed structure as in any of variations 14 through 18 further including forming cut outs in at least one of the plurality of spans, support headers, plurality of vertical supports, at least one welded wire mesh, at least one metal mesh sheet, and form boards for windows.

According to variation 20, a method for forming at least one to-be-constructed structure may include installing a plurality of form boards approximately outside of desired dimensions of at least one to-be-constructed wall; attaching a keyboard on an interior side of the plurality of form boards such that a top surface of the keyboard is flush with a top of at least one of the plurality of form boards, wherein the keyboard is sized and shaped to define a keyway in the at least one to-be-constructed wall; defining at least one notch in the keyboard to receive at least one vertical support; installing at least one vertical support anchored below a desired footer, the at least one vertical support being constructed and arranged to support at least one support header; installing at least one span constructed and arranged to extend between adjacent vertical supports and support headers; installing at least one vertical strap within the at least one span, the at least one vertical strap including a j-hook where in installing the at least one vertical strap includes positioning the j-hook toward an interior side of a to-be-constructed wall; suspending, within the keyway, at least one welded wire mesh from the at least one vertical strap; installing at least one vertical brace; installing at least one horizontal brace within the j-hook; connecting the at least one vertical brace and the at least one horizontal brace, wherein arrangement and connectivity of the at least one vertical brace and the at least one horizontal brace is configured to maintain the integrity of the desired shape and thickness of a to-be-constructed structure; forming at least one slab; removing the at least one keyboard; installing, within the keyway, a first metal mesh sheet; installing, within the keyway, a second metal mesh sheet such that the at least one welded wire mesh is disposed between and spaced from both the first metal mesh sheet and second metal mesh sheet; and pouring concrete within the keyway and between the first metal mesh sheet and second metal mesh sheet to form the at least one to-be-constructed structure.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that at least one elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

I claim:

1. A building system for forming at least one to-be-constructed structure, comprising:

a wall assembly comprising a plurality of expanded metal mesh sheets and at least one welded wire mesh sheet;

a foundation assembly comprising a plurality of form boards for framing out a to-be-constructed slab and at least one keyboard removably coupled to the form boards, wherein the at least one keyboard is removable and constructed and arranged to define a keyway in the to-be-constructed slab; and a framing assembly comprising:

a plurality of vertical supports structured to be vertically disposed on an underlying surface, each of the plurality of vertical supports being in a spaced apart relation from one another, each of the plurality of vertical supports having an exposed end to removably engage with one of a plurality of support headers, and a plurality of spans, wherein each of the plurality of spans is structured to extend at least partially between adjacent vertical supports of the plurality of vertical supports, and wherein each of the plurality of spans is structured to extend between and be received by corresponding support headers of the plurality of support headers;

wherein the plurality of spans is configured to allow for removability of the plurality of support headers and the plurality of spans for subsequent reuse; and wherein the at least one keyboard includes a notch that receives a first vertical support of the plurality of vertical supports.

2. The building system as in claim 1, wherein the at least one welded wire mesh sheet is disposed between a pair of expanded metal mesh sheets of the plurality of expanded metal mesh sheets.

3. The building system as in claim 2, wherein each of the plurality of expanded metal mesh sheets is positioned a distance from one another, the distance between each of the plurality of expanded metal mesh sheets equaling a thickness of a to-be-constructed wall.

4. The building system as in claim 1, wherein the wall assembly further comprises at least one vertical strap comprising a j-hook.

5. The building system as in claim 4, wherein the at least one vertical strap extends downward from at least one of the plurality of spans and wherein the j-hook is positioned towards an interior portion of a to-be-constructed wall in order to receive a horizontal brace.

6. The building system as in claim 1, wherein at least one of the plurality of spans defines a slot sized and shaped to receive a vertical strap therein.

7. The building system as in claim 1, wherein at least one span of the plurality of spans defines a plurality of slots on a downward facing surface of the at least one span and further defines a plurality of corresponding slots on an upward facing surface of the at least one span, the plurality of slots and the plurality of corresponding slots being constructed and arranged to receive vertical straps therein.

8. The building system as in claim 1, wherein the wall assembly further comprises at least one vertical strap comprising a j-hook and defines an embedment line constructed and arranged to identify a lower portion of the at least one vertical strap to be disposed within a wall material during use.

9. The building system as in claim 1, wherein the wall assembly further comprises at least one horizontal support positioned laterally between adjacent vertical supports of the plurality of vertical supports, wherein the at least one horizontal support is constructed and arranged to seat within at least one j-hook of at least one strap.

10. The building system as in claim 1, wherein the at least one keyboard is removably fastened to the form boards.

11. The building system as in claim 1, wherein the framing assembly comprises at least one vertical brace disposed on at least one of an interior side or an exterior side of a to-be-constructed wall, and at least one horizontal strap extending from a span of the plurality of spans, wherein the at least one vertical brace is removably coupled to the at least one horizontal strap.

12. The building system as in claim 11, wherein the framing assembly comprises at least one exterior horizontal brace removably coupled to a second vertical support of the plurality of vertical supports.

13. The building system as in claim 12, wherein the at least one vertical brace and the at least one exterior horizontal brace are configured to maintain the integrity of the desired shape and thickness of a to-be-constructed structure.

* * * * *